United States Patent [19]

D'Angiolillo et al.

[11] 4,310,254

[45] Jan. 12, 1982

[54] KEYBOARD DEVICE FOR PROCESSING LINGUISTIC INFORMATION

[75] Inventors: D'Angiolillo; Encho Y. Karmakov; Kiril T. Shakrachki; Metodi T. Shakrachki; Stoyan H. Stoyanov; Todorka N. Vassileva; Todor P. Trifonov, all of Sofia, Bulgaria

[73] Assignee: Cuv "Progress", Sofia, Bulgaria

[21] Appl. No.: 125,918

[22] Filed: Feb. 29, 1980

Related U.S. Application Data

[63] Continuation-in-part of Ser. No. 900,115, Apr. 26, 1978, abandoned.

[30] Foreign Application Priority Data

Apr. 26, 1977 [BG] Bulgaria ..... 36127

[51] Int. Cl.[3] ..... B41J 5/00; B41J 5/10

[52] U.S. Cl. ..... 400/109; 400/484; 400/486

[58] Field of Search ..... 400/91-95, 400/98-102, 482, 484, 486, 109

[56] References Cited

U.S. PATENT DOCUMENTS

| | | | |
|---|---|---|---|
| 1,108,661 | 8/1914 | Anderson | 400/93 |
| 1,913,831 | 6/1933 | Clark | 400/94 |
| 2,192,594 | 3/1940 | Brand et al. | 400/101 X |
| 3,225,883 | 12/1965 | Ayres | 400/100 X |
| 3,557,927 | 1/1971 | Wright et al. | 400/94 |
| 3,558,820 | 1/1971 | Baisch et al. | 400/94 X |
| 3,597,538 | 8/1971 | Binenbaum | 400/94 X |
| 3,665,115 | 5/1972 | Snook | 400/91 X |
| 3,832,733 | 8/1974 | Eldridge | 400/94 X |
| 3,892,915 | 7/1975 | Budworth et al. | 400/482 |
| 3,945,482 | 3/1976 | Einbinder | 400/92 X |
| 4,042,777 | 8/1977 | Beguaert et al. | 400/100 X |

*Primary Examiner*—Clifford D. Crowder

[57] ABSTRACT

A device for the processing of linguistic information containing a keyboard unit, an electronic processing unit and an output registration unit, with the keyboard unit processing keys for symbols distributed over a right hand side group to be operated by the right hand and a left hand side group to be operated by the left hand. The device has an electronic processing unit containing a memory, a decoder and a control unit, with the keyboard unit possessing space keys, the keys for symbols in the right hand side group having priority over the keys for symbols in the left hand side group. The keys for symbols in the right hand side group have priority from left to right and from top to bottom; the keys for symbols in the left hand side group have priority from right to left and from top to bottom. The keys for symbols in the end outer columns of both groups are disposed one row lower, with each of the keys for symbols in the left hand group and each of the keys in the right hand group, carrying a group of symbols arranged by priority, with the symbols presented once on the keys for symbols in each group.

15 Claims, 5 Drawing Figures

KEYBOARD DEVICE FOR PROCESSING LINGUISTIC INFORMATION

This application is a continuation-in-part of application Ser. No. 900,115, filed Apr. 26, 1978, now abandoned.

This invention relates to a device for the introduction of linguistic information. The said device is used in stenotyping, typewriting, and similar activities connected with the introduction of linguistic information.

A syllabic stenographic machine is known using a polyphone method for the introduction of information. This machine includes a keyboard unit, an electronic processing unit, and an output registration unit. The keyboard unit has keys for symbols distributed over a right hand side group to be operated by the right hand, and a left hand side group to be operated by the left hand. The electronic processing unit includes most often a memory, a decoder and a control unit. The keyboard unit has space keys, a tabulator key, a new line key, a carriage return key, a release key and a backspace key. The keys for symbols carry one or two symbols. A large part of the symbols are duplicated in the left and right hand side groups. Furthermore, some symbols are absent from the keys for symbols, and for their registration it is necessary to touch a combination of various keys for symbols.

The shortcomings of the known device for the introduction of linguistic information arise mainly because of shortcomings of the keyboard unit. Basically they consist in the following: the great number of keys—50; only a part of some types of syllables can be written by means of one stroke; only part of the consonant-vowel-consonant syllables have been included, and the syllables of the consonant-consonant-vowel type cannot be written by means of a single stroke.

For many of the consonants and for some of the vowels the indication of the corresponding phoneme is made by means of the so-called code-letters—a combination of several real letters. After a code-letter one could not add another consonant letter. In the English language about one-third of the symbols are expressed by means of a combination of 2, 3 or 4 keys. For that reason it is not possible to introduce every one of all types of syllables by means of a single stroke.

Another stenographic system is known which also uses the polyphonemic method for the introduction of information.

The system uses a keyboard positioned for operation with the left and right hands and containing a great number of keys. The keys can be operated separately or simultaneously. The keys are distributed into four groups: a first group wherein each key is representing a prefix; a second group wherein each key represents a letter; a third group wherein each key represents a suffix; and a fourth group wherein each key contains a vowel and every vowel is represented twice or three times in the group. The fourth group is positioned under the first, the second and the third groups. The keyboard also comprises a number of keys representing one or more whole words, as well as a group of keys for the control of the words. The system possesses a memory containing the memorized words which are to be printed. It also includes a printer, as well as means for connecting the printer with the memory.

The touched keys are determined through scanning from left to right and from top to bottom. The sequence of the output signals is determined by a special key which is operated in advance.

The shortcomings of this stenographic machine are the complexity of the keyboard unit, which greatly hampers the operator's work, as well as the complexity of the electronic processing unit including the computing device.

A common shortcoming of the known machines is that the learning process is difficult and lengthy, and the work of the operator is psychologically inhibited.

The objects of the invention are the provision of a device permitting the introduction of every one of all types of syllables by means of a single stroke on a keyboard containing a minimal number of keys; convenient operation with the keyboard in any language; and the facilitating of the process of learning and the work of the operator thanks to the possibility of introducing the natural distribution of syllables.

The above objects are achieved by means of a device for introducing linguistic information comprising a keyboard unit, an electronic processing unit, and an output registration unit, with the keyboard unit possessing keys for symbols distributed over a right hand side group to be operated by the right hand, and a left hand side to be operated by the left hand. The electronic processing unit comprises a memory, a decoder and a control unit. The keyboard unit has space keys. According to the invention the keys for symbols in the right hand side group have priority over those in the left hand side group. The keys for symbols in the right hand side have priority from left to right and from top to bottom, and the keys for symbols in the left hand side have priority from right to left and from top to bottom. The keys for symbols from the end outward columns of both groups are positioned one line below. Every one of the keys for symbols carries a group of symbols arranged by priority. The symbols are represented singly on the keys for symbols. The keyboard unit has keys for the selection of symbols whose number is equal to the maximum number of symbols carried by a single key for symbols, a key for reversing the priority of the symbols on the keys for symbols, keys for reversing the priority of the left hand side keys for symbols with respect to those of the right hand side, a key for reversing the priority of the keys for symbols in both groups, and keys for inserting symbols from the left hand side group between symbols from the right hand side. Furthermore, separate keys are provided for the function of writing of a capital letter, for passing to a new line, and for passing to a new line with a space and a capital letter.

The keyboard unit is connected with the input "Start" of the control unit, as well as with the input of the memory, which has a duplex coupling to the control unit. The control unit comprises a command unit having as an input the "Start" input as well as a duplex coupling to a counting unit and the output of a timing pulse generator. That generator has an output connected to the counting unt. The command unit has outputs to the capital letter unit, the new line unit and the normal information unit. The new line unit, the capital letter unit and the normal information unit have outputs through an "OR" gate to the decoder.

The keys for changing the priority of the keys for symbols from the left hand side group with respect to the keys for symbols from the right hand side group are positioned correspondingly above the uppermost keys for the symbols from the left hand side group with one such key for any column of keys for symbols; the keys for the selection of symbols are positioned under the keys for symbols, the keys for the selection of the first, the second and the third symbols form a group to be operated by the thumb of the right hand, the key for the selection of the fourth symbol is positioned under the keys of the extreme right column of the right hand side group of keys, and left of it there is the key for selection of the fifth symbol with the key for the selection of the sixth symbol being positioned under the keys for symbols of the third column from right to left from the left hand side group of keys; the key for reversing the priority of the symbols on the keys for symbols, the key for reversing the priority of the keys for symbols in the group as well as the keys for the introduction of symbols from the left hand side group between the symbols from the right hand side group form a group to be operated by the thumb of the left hand and are positioned under the keys for symbols; the key for reversing the priority of the symbols on the keys for symbols is positioned uppermost in the group, and below that key there are positioned from right to left the key for reversing the priority of the keys for symbols in the group as well as the keys for the introduction of symbols from the left hand side group between symbols from the right hand side group.

One of the keys for the introduction of symbols accomplishes the introduction of symbols from the left hand side group between symbols from the right hand side group following the first printed symbol, and the other one the introduction of symbols from the left hand side group between symbols from the right hand side group following the second printed symbol.

The additional functions are preferably realized as follows: the key for selection of the third symbol when operated separately performs the function of passing to a new line, the key for the selection of the second symbol when operated separately performs the function of printing as a capital letter the first letter of the next introduced group of symbols and the remaining letters as small letters; and the keys for the selection of the first and the third symbols when operated simultaneously perform the function of passing to a new line with a new line spacing and a capital letter. The keys for the selection of the first and the second symbols when operated simultaneously perform the function of printing only capital letters until the simultaneous pressing of the same group of keys.

The keys for symbols from the right hand side group are arranged in two rows with the first row containing four keys and the second one containing three keys; the keys for symbols from the left hand side group are arranged in two rows, each with four keys. The priority order of the keys for symbols from the right hand side group from left to right is first, second, third and fourth key in the first row, first, second and third key in the second row, and that of the keys for symbols from the left hand side group from right to left is first, second, third and fourth key in the first row and first, second, third and fourth key in the second row. Above each column of the right hand side group of keys for symbols there is positioned a space key. Each key for symbols can carry information for up to six symbols. The keys for symbols are positioned in such a way that each finger of both hands can operate several keys simultaneously.

The advantages of the device, according to the invention, manifest themselves above all in the fact that the keyboard unit materializes the natural syllabic structure of the word. The introduction of linguistic information by syllables is effected by means of a single multifinger stroke on the keys which can guarantee a speed of introduction up to 1200 phonemes/min, printed by the registration unit in the form of a normal text. The speed of introduction of information is limited by the speed of registration of the information by the registration unit. The device permits the introduction of every one of all types of syllables. The keyboard unit is realized with a minimal number of keys allowing the introduction of the symbols without coding and is convenient for keyboard operation in every natural language. This facilitates the work and the training of operators.

A preferred embodiment of the device according to the invention is shown in the accompanying drawings, wherein.

Figure 1:
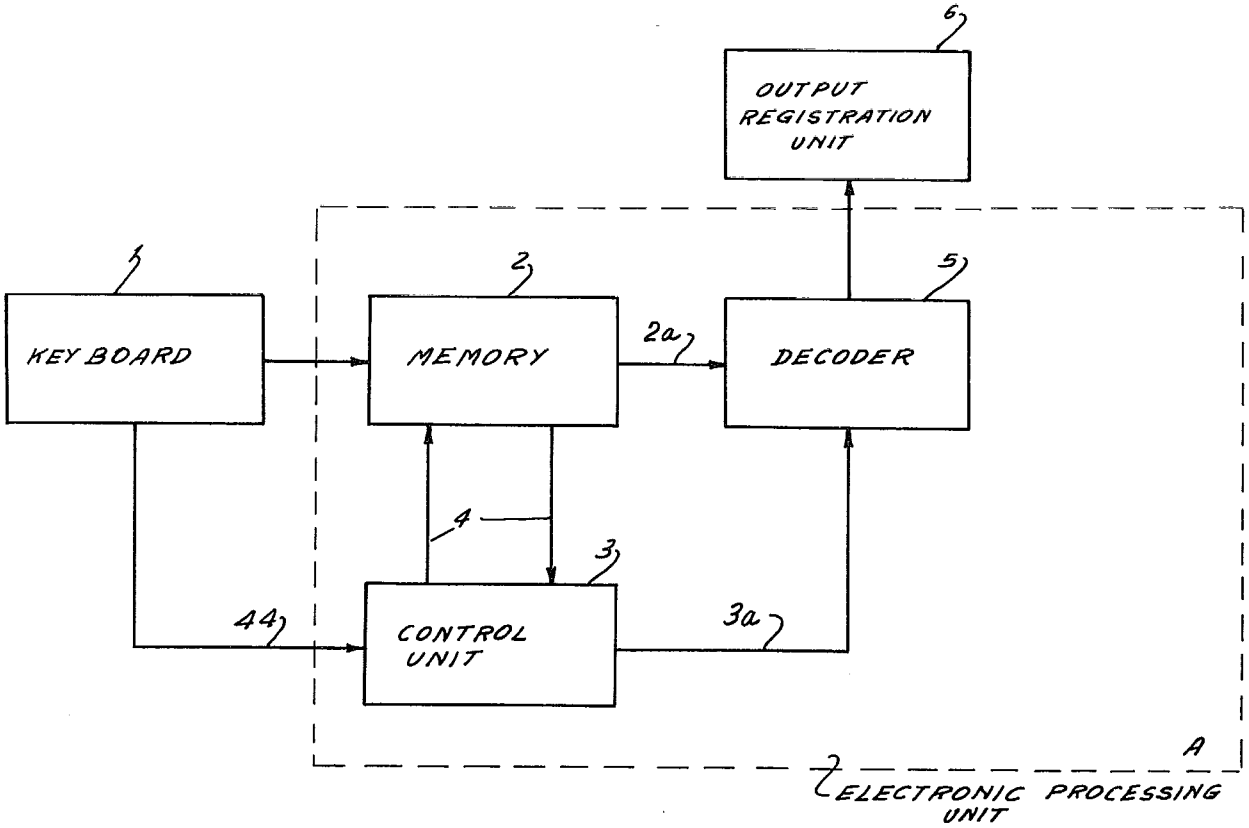
FIG. 1 is a block diagram of the device.

Referring to FIG. 1, a keyboard unit 1 is connected with a memory 2 and a control unit 3. The memory 2 and the control unit 3 have a duplex link 4 between them, and their outputs **2*a* and 3*a*, respectively, are fed through a decoder 5 towards the output registration unit 6. The memory 2, the control unit 3 and the decoder 5** are shown incorporated into an electronic processing unit generally designated A.

Figure 2:
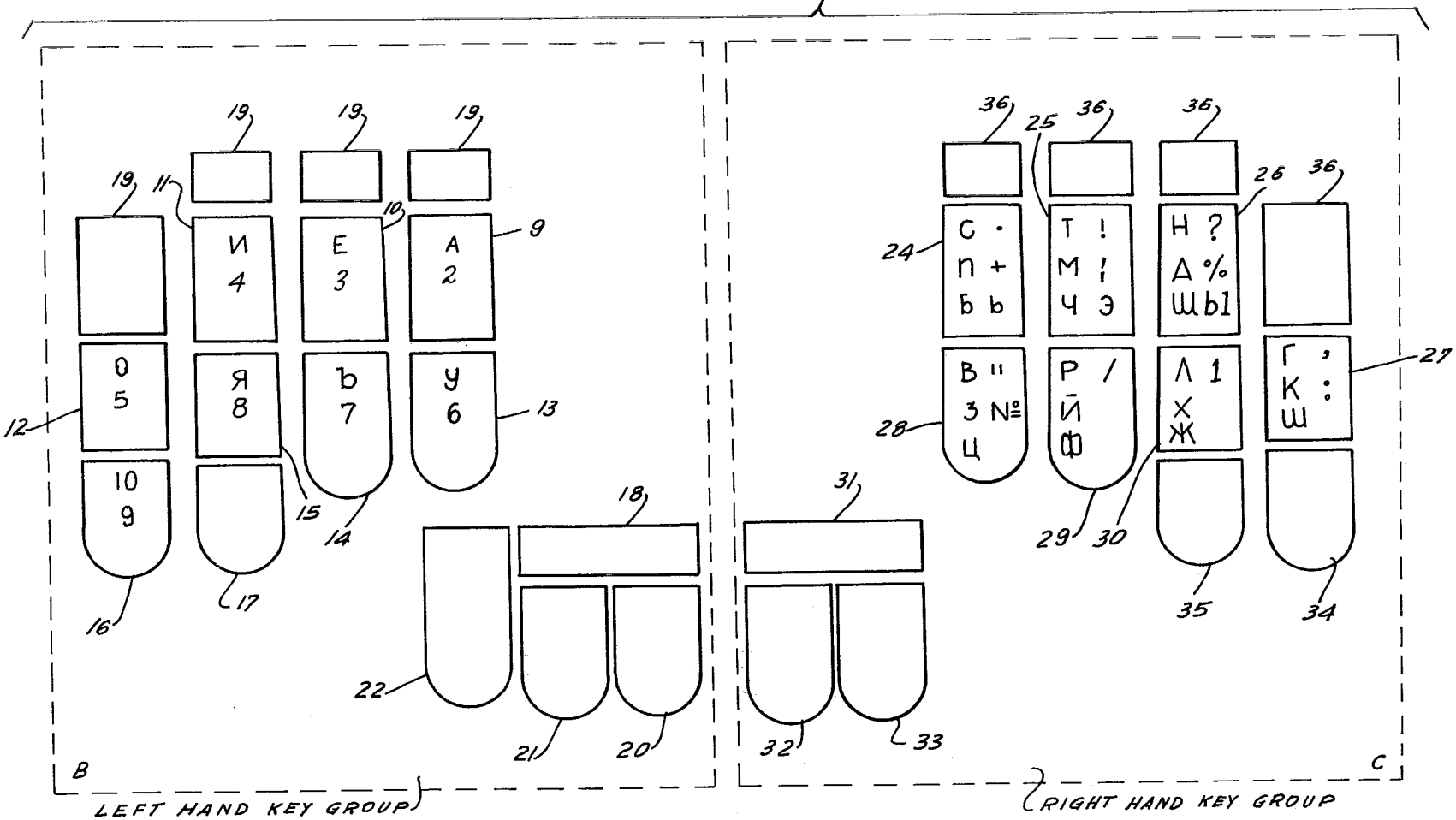
FIG. 2 shows the arrangement of the keys in the keyboard unit.

FIG. 2 shows the arrangement of the keys on the keyboard of the keyboard unit 1. It has keys forming a left hand side group B to be operated by the left hand. Group B includes keys for symbols from 9 to 16, a key 17 for selection of a sixth symbol, a key 18 for reversing the priority of the symbols on the keys for symbols from the left hand side group with respect to the keys for symbols from the right hand side group, a key 20 for reversing the priority of the keys for symbols in the groups, a key 21 for the introduction of symbols from the left hand side group between symbols from the right hand side group following the first printed symbol, and a key 22 for the introduction of symbols from the left hand side group between symbols from the right hand side group following the second printed symbol.

The right hand side group C of the keyboard unit 1 is to be operated by the right hand and includes keys for symbols from 24 to 30, a key 31 for selection of a first symbol, a key 32 for selection of a second symbol, a key 33 for selection of a third symbol, a key 34 for selection of a fourth symbol, a key 35 for selection of a fifth symbol as well as the space keys 36. The number of the keys for the selection of symbols is six—according to the number of symbols from the greatest set of symbols carried by one key for symbols. The keys 24–30 for symbols from the right hand side group C have priority over the keys 9–16 for symbols from the left hand side group B. The keys 24–30 for symbols have priority in the group from left to right and from top to bottom, while the keys 9–16 for symbols have priority in the group from right to left and from top to bottom. The symbols carried by the keys for symbols are arranged by priority and are represented only once. The space keys 36 are positioned above the keys for symbols from the right hand side group C. The keys 19 for changing the priority of the keys for symbols from the left hand side group with respect to the keys for symbols from the right hand side group are positioned correspondingly above the keys for symbols 9, 10, 11, 12 from the left hand side group B—one for each column of keys for symbols.

The keys for selection of symbols 17 and 31 to 35—are positioned lower than the key for symbols, with the key 31 for selection of the first symbol, the key 32 for the second symbol and the key 33 for the third symbol forming a group to be operated by the thumb of the right hand. The key 34 for the selection of the fourth symbol is positioned under the keys at the extreme right column of keys of the right hand side group C, and left of it there is positioned the key 35 for selection of the fifth symbol. The key 17 for the selection of the sixth symbol is positioned under the keys for symbols from the third column from right to left of keys for symbols from the left hand side group B.

The key 18 for reversing the priority of the symbols on the keys for symbols, the key 20 for reversing the priority of the keys for symbols in the group C, as well as the keys 21 and 22 for the introduction of symbols from the left hand side group between symbols from the right hand side group form a group to be operated by the thumb of the left hand, and are positioned lower than the keys for symbols. Furthermore, the key 18 for reversing the priority of the symbols on the keys for symbols is positioned uppermost in the group, and under it from right to left are positioned the key 20 for reversing the priority of the keys for symbols in the group, the key 21 for the introduction of symbols from the left hand side group between symbols from the right hand side group following the first printed symbol, and the key 22 for the introduction of symbols from the left hand side group between symbols from the right hand side group following the second printed symbol. The keys for symbols from the right hand side group C are arranged in two rows with the first row containing four keys 24, 25, 26, 27, and the second row containing three keys 28, 29, 30. The keys for symbols from the left hand side group B are also arranged in two rows with the first row containing the keys for symbols 9, 10, 11, 12 and the second row containing the keys for symbols 13, 14, 16. The keys for changing the priority of the keys for symbols from the left hand side group with respect to the keys for symbols from the right hand side group 19 are placed above the group B—one for each column of keys for symbols.

The keys for selection of symbols 17 and 31 to 35—are positioned lower than the key for symbols, with the keys 31 for selection of the first symbol, the key 32 for the second symbol and the key 33 for the third symbol form a group to be operated by the thumb of the right hand. The key 34 for the selection of the fourth symbol is positioned under the keys at the extreme right column of keys of the right hand side group C, and left of it there is positioned the key 35 for selection of the fifth symbol. The key 17 for the selection of the sixth symbol is positioned under the keys for symbols from the third column from right to left of keys for symbols from the left hand side group B.

The key 18 for reversing the priority of the symbols on the keys for symbols, the key 20 for reversing the priority of the keys for symbols in the group C as well as the keys 21 and 22 for the introduction of symbols from the left hand side group between symbols from the right hand side group form a group to be operated by the thumb of the left hand, and are positioned lower than the keys for symbols. Furthermore, the key 18 for reversing the priority of the symbols on the keys for symbols is positioned uppermost in the group, and under it from right to left are positioned the key 20 for reversing the priority of the keys for symbols in the group, the key 21 for the introduction of symbols from the left hand side group between symbols from the right hand side group following the first printed symbol, and the key 22 for the introduction of symbols from the left hand side group between symbols from the right hand side group following the second printed symbol.

As can be seen from FIG. 2 the key 27 for symbols, and keys 12 and 16 at the outer ends of groups B and C, respectively, are lower by almost a whole row for greater convenience in the work of the little fingers of both hands. The keys for symbols in the right hand side group C having the following priority sequence from left to right: first key 24, second key 25, third key 26 and fourth key 27 from the first row; first key 28, second key 29 and third key 30 from the second row. The keys for symbols from the left hand side group B have the following priority sequence from right to left: first key 9, second key 10, third key 11 and fourth key 12 from the first row; first key 13, second key 14, third key 15 and fourth key 16 from the second row. The keys for symbols in the case for the Bulgarian language carry symbols as follows: in the first row of the left hand side group: key 9 carries letter A and FIG. 2, key 10 carries letter E and FIG. 3, key 11 carries letter И and FIG. 4, key 12 carries letter O and FIG. 5; in the second rod: key 13 carries letter y and FIG. 6, key 14 bears letter Ъ and FIG. 7, key 15 bears the Cyrillic letter Я and FIG. 8, key 16 bears letter Ю and numeral 9; in the first row of the right hand side group C: key 24 bears letter C, Л, Б, full stop, the + sign and the letter b; key 25 bears letters T, M, the Cyrillic letter У, exclamation point, and the Cyrillic letter Э, sign of equality, key 26 bears letters H, Д, Щ, question-mark, the % sign and the Russian letter Ы; key 27 bears letters Г, K, Ш, comma, and colon; in the second row: key 28 bears letters B, 3, Ц as well as the signs >> (inverted commas) and № ; key 29 bears letters P, Й and Ф, as well as the / sign; key 30 bears letters Л, X and Ж as well as the numeral 1.

The control unit 3 (FIG. 3) includes a command unit 37 having a duplex coupling 37*a* to a counting unit 38 as well as outputs 37*b*, 37*c* and 37*d*, respectively, to a capital letter unit 39, new line unit 40 and normal information unit 41. The outputs of the capital letter unit 39, the new line unit 40 and the normal information unit 41 are coupled through an OR-gate 42 to an output 3*a* to the decoder 5 (FIG. 1). The command unit 37 is connected to the memory 2 by means of the duplex coupling 4. The clock or timing pulse generator 43 has an input 37*e* from the command unit 37 and an output 43*a* to the counting unit 38. The input "Start" 44 from the keyboard unit 1 is fed to the command unit 37.

This device could possess also other keys which are characteristic for the universal typewriters e.g. new line key, back space key, tabulator key, stencil and ribbon color switch key, etc. The symbols of the Cyrillic alphabet and respectively those for the Bulgarian language are arranged according to the priority of the keys for symbols in a priority sequence from top to bottom as follows (FIG. 2):

For the left hand side group from right to left—on the first (upper) row:

| Keys | First | Second | Third | Fourth |
|---|---|---|---|---|
| Symbols | A | E | И | 0 |
| | 2 | 3 | 4 | 5 |

and on the second (lower) row:

| Keys | First | Second | Third | Fourth |
|---|---|---|---|---|
| Symbols | у | Ъ | Я | Ю |
| | 6 | 7 | 8 | 9 |

For the right hand side group from left to right—on the first (upper) row:

| Keys | First | Second | Third | Fourth |
|---|---|---|---|---|
| Symbols | С | Т | Н | Г |
| | Л | М | Д | К |
| | Б | У | Щ | Ш |
| | . | ! | ? | , |
| | + | = | % | : |
| | b | Э | bl | |

and on the second (lower) row:

| Keys | First | Second | Third |
|---|---|---|---|
| | В | Р | А |
| | Э | Й | Х |
| | Ц | Ф | Ж |
| | № | 1 | 7 |

Figure 4:
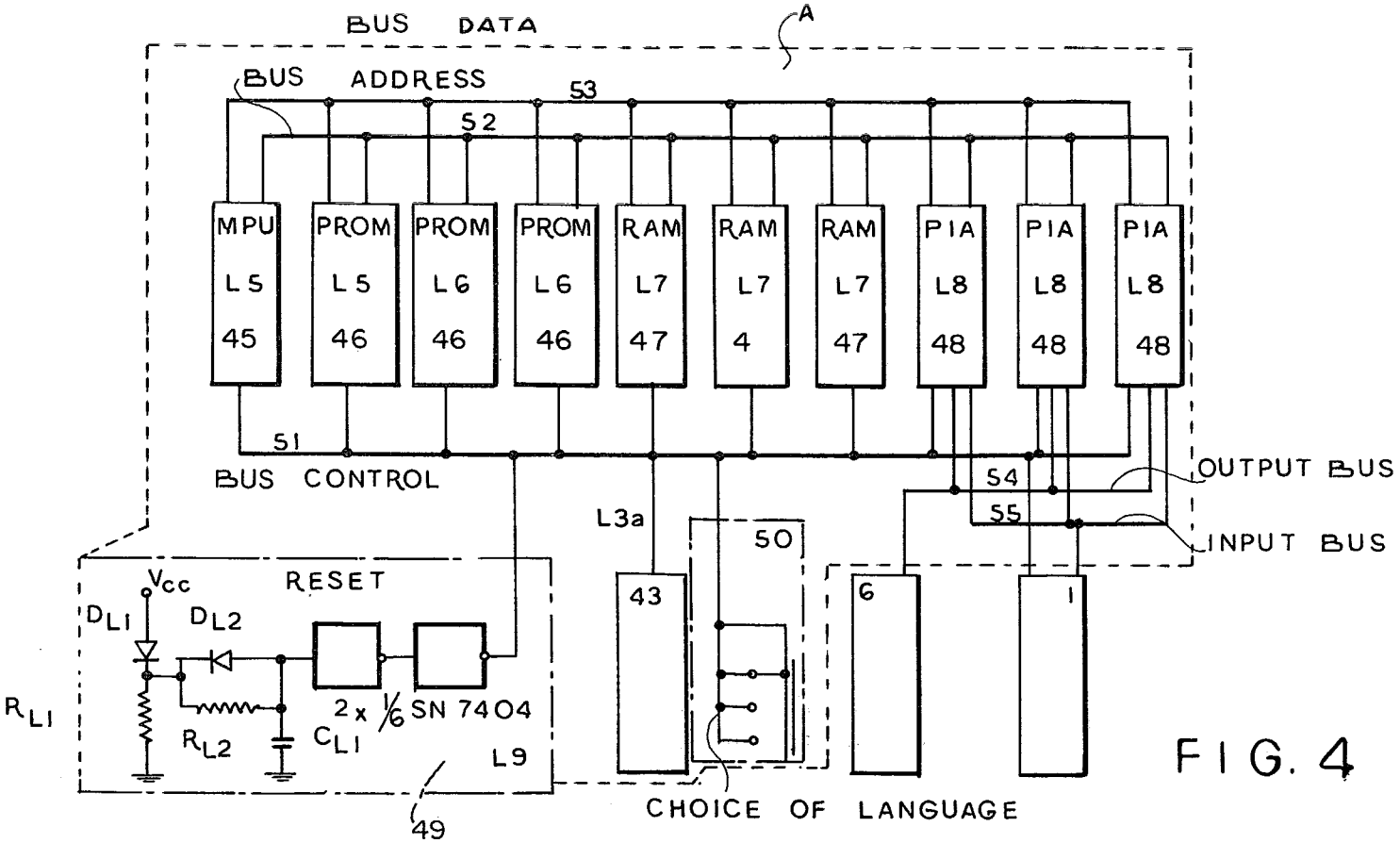
FIG. 4 is a principal electric diagram of the electronic processing unit.

The principal electric diagram of the electronic processing unit A (according to the block diagram of FIG. 1) shown in FIG. 4 is represented as microprocessor realization.

The microprocessor system used includes: one microprocess unit (MPU) 45; three programmable passive memories (PROM)—46; three memories with random access (RAM)—47; three peripheral interface adapters (PIA)—48, nullifying circuit (RESET)—49, clock generator—43 and switch for language selection—50. The so-cited components of the microprocessor system are connected by means of three types of buses: control bus—51, address bus—52 and data buses—53. PIA—48 are connected by the: input buses—55 and output buses—54. Output buses—54 are linked with the output registering device—6, and the input bus—55 are linked with the key board of the device.

Figure 3:
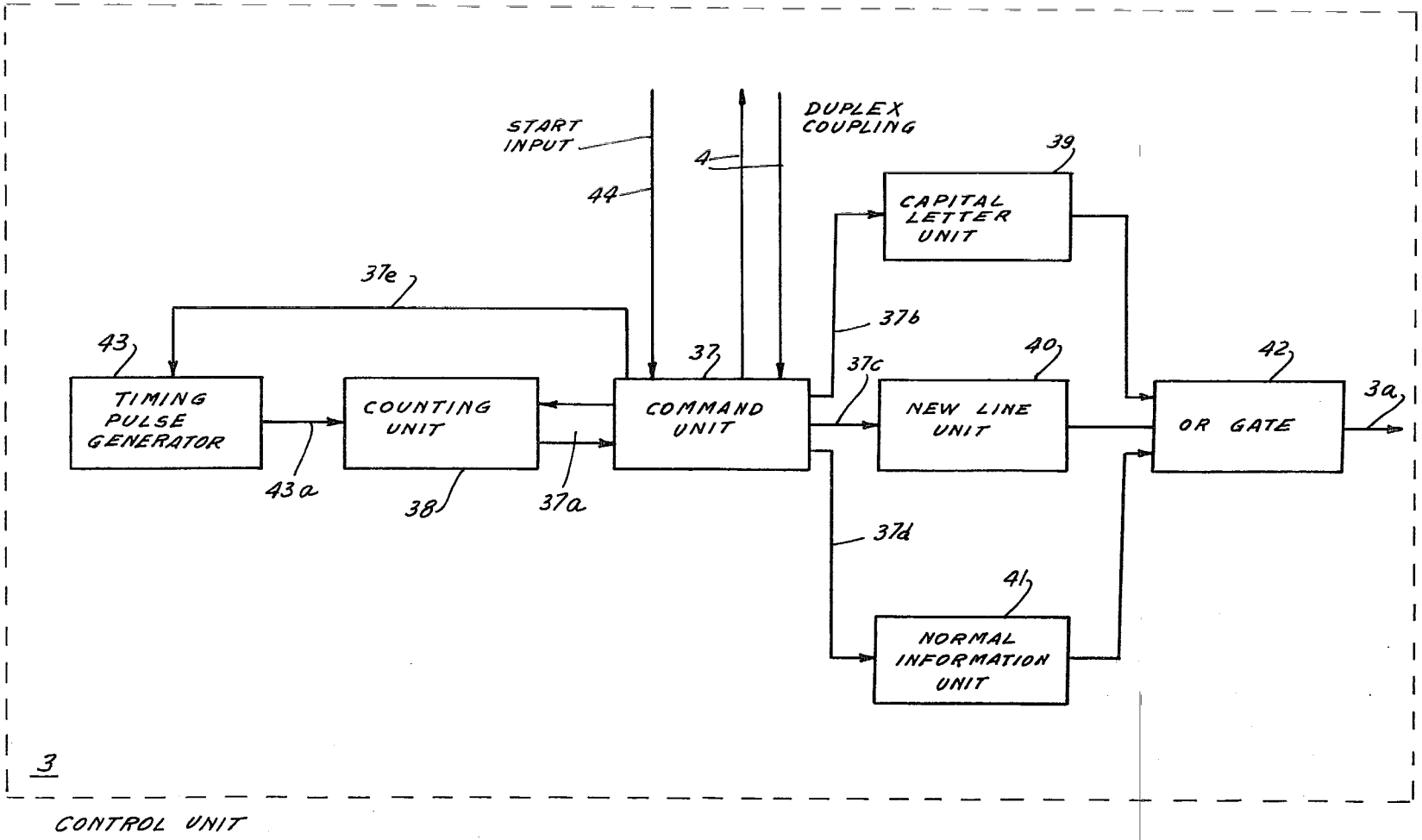
FIG. 3 is a block diagram of the control unit.

Because of the specific microprocessor performance, there is not a full correspondence between the so-described components of the microprocessor system and the functional units of the electronic processing unit—A, shown in FIGS. 1 and 3. The functions of the control unit—of FIGS. 1 and 3 are performed by the microprocessor units 43, 45, 46, 47, in FIG. 4; the functions of the unit "memory"—2 of FIG. 1 are performed by units 46, 47 and 48 in FIG. 4, and the functions of the decoding block—5 of FIG. 1 are performed by units 43, 45, 46, 47 and 48 of FIG. 4.

Figure 5:
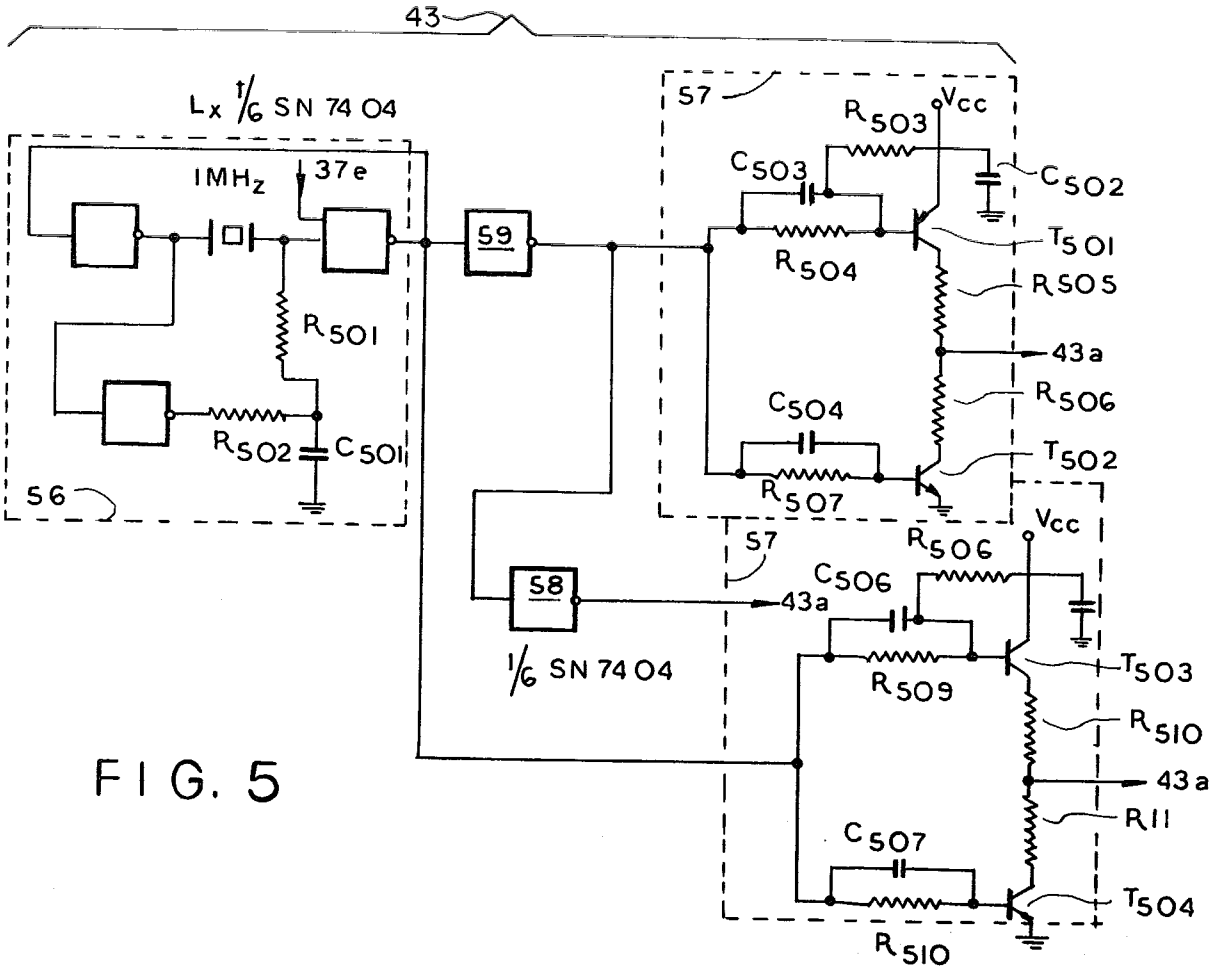
FIG. 5 is a principal electric diagram of the clock-generator from the control unit of the electronic processing unit.

The principle electric diagram of FIG. 5 shows pulse generator 43 comprising the quartz generator 56, two separating amplifiers (buffers) 57 and one inverter—buffer 58, the output of the quartz generator—56 is directly connected to one of the buffers 57, through inverter 59 to the second buffer 57 and to the inverter—buffer 58. Outputs 43*a* of all buffers represent outputs of the pulse generator—43 and are connected to the control buses 51 (FIG. 4).

The above-described device functions in the following manner:

Writing of normal information by the output device

A group of keys is pressed by means of which a selected group of symbols can be printed. The information from the depressed keys is stored in the memory 2. After the release of all depressed keys from the keyboard 1, a "Start" signal is formed which is fed to the control unit 3. Following the "start" signal the control unit 3 produces a signal for the transfer of the information from the memory 2 into the command unit 37. That information transferred into the command unit 37 indicates which keys for selection of symbol and which keys for reversing the priority have been depressed. The remaining part of the information registered in the memory 2 is transferred into the decoder 5 for decoding. The command unit 37 activates the pulse generator 43 and the counting unit 48. The pulse generator 43 generates timing pulses necessary for the synchronized operation of the device. The counting unit 38 counts the symbols registered by the output registration unit 6 and controls the sequence of the execution of the commands generated by the command unit 37. On the basis of the information fed into the command unit 37, signals are produced which are fed to the decoder through the normal information unit 41 and the OR-gate 42 for the purpose of controlling the sequence of the decoded symbols from decoder 5 to the output registration unit 6. After the printing by the output registration unit 6 of all symbols which have been introduced by means of a single multifinger stroke, the device returns to its initial state and is in condition to process a newly introduced batch of symbols.

The microprocessor system functions as follows (shown in FIG. 4): in the PROM is recorded the program for the functioning of the device. In the microprocessor system are recorded for instance four programs (for 4 separate languages) and the selection of a separate language is done by means of the switch "language selection"—50.

PIA 48 give the link between the microprocess system from one hand and the keyboard 1 and the output registering device 6 from another. In the PIA's—48 registers are kept the data about the activated keys till the moment they are depressed. Then the PIA—48 information is transferred in the RAM 47 where it is stored for processing. In the RAM 47 units are stored also the mediate results from the processing of the introduced data and the already processed information is transferred through PIA 48 to the output registering device.

The reset circuit 49 is used to put the microprocess system in its initial position, after switching on the supply voltage.

The clock generator 43 generates two pulse sequences needed for the work of the microprocessor system.

Depressing only keys for symbols from the right and left hand side groups

The output registration unit 6 writes down the symbols in a sequence one next to the other according to the priority of the keys for symbols from the right hand side group, and afterwards writes down consecutively next to them the symbols from the left hand side group according to their priority in that group. Since no key for selection of symbols has been depressed, the first symbols carried by the keys for symbols are printed. The same information is written down by the output registration unit when, along with the keys for symbols, the key 31 for selection of the first symbol is also depressed.

Depressing keys for symbols and keys for selection of symbols

In order to select the second symbols carried by the keys for symbols, it is necessary to activate the corresponding keys for symbols from the left and the right hand side groups as well as the key 32 for selection of second symbol. The output registration unit 6 writes down consecutively the symbols one next to the other according to the priority of the keys for symbols from the right hand side group, and afterwards next to them writes down consecutively the symbols from the left hand side group according to their priority, with all printed symbols being the second symbols carried by the keys for symbols. In the same way there are selected the third, fourth, fifth and sixth symbols, i.e. by simultaneously depressing with the keys for symbols the corresponding keys 32, 33, 34, 35 and 17 for selection of symbols.

Depressing keys for symbols from the right and the left hand side groups along with keys 19 for reversing the priority of the keys for symbols from the left hand side group with respect to the keys for symbols from the right hand side The output registration unit 6 writes down consecutively the symbols one next to the other according to the priority of the keys for symbols from the left hand side group B, and afterwards next to them writes down consecutively the symbols from the right hand side group C accordiing to their priority.

Depressing keys for symbols from the left and the right hand side group and a key 20 for reversing the priority of the keys for symbols in the group C The output registration unit 6 writes down consecutively the symbols one next to the other according to the new priority of the keys for symbols from the right hand side group, and afterwards next to them writes down consecutively the symbols from the left hand side group according to the new priority.

Depressing a key for symbols and several keys for selection of symbols

The output registration unit 6 writes down consecutively and according to their priority the symbols carried by the depressed key for symbols in the sequence—first symbol, second symbol, third symbol, fourth symbol, fifth symbol, six symbol according to the simultaneously depressed keys for selection of symbols.

Depressing a key for symbol, keys for selection of symbols and a key 18 for reversing the priority of the symbols on the keys for symbols The output registration unit 6 writes down consecutively and according to the new priority the symbols carried by the key for symbols in a reversed sequence, i.e. sixth symbol, fifth symbol, fourth symbol, third symbol, second symbol, first symbol.

Depressing keys for symbols from the right and the left hand side group as well as the key 31 for the introduction of symbols from the left hand side group between symbols from the right hand side group after the first printed symbol The output registration unit 6 first writes down the symbol from the right hand side group C having the highest priority, then next to it writes down the symbols from the left hand side B according to their priority, and finally next to them the remaining symbols from the right hand side group C.

Depressing keys for symbols from the left and the right hand side group as well as key 22 for the introduction of symbols from the left hand side group between symbols from the right hand side group after the second printed symbol from the right hand side group The output registration unit 6 writes down the first two symbols from the right hand side group C having the highest priority, then writes down next to them the symbols from the left hand side group B according to their priority, and finally next to them the remaining symbols from the right hand side group C.

Depressing a key for the introduction of symbols from the left hand side group between symbols from the right hand side group as well as a key for reversing the priority of the keys for symbols from the left hand side group with respect to the keys for symbols from the right hand side group In such a case only the action of the key for the introduction of symbols from the left hand side group between keys for symbols from the right hand side group is effected.

Depressing several keys for selection of symbols and several keys for symbols

The output registration unit 6 writes down consecutively one next to the other the symbol with the highest priority from the key for symbol with the highest priority, then the symbol with lower priority from the key with lower priority etc. If the number of the keys for selection of symbols is greater than the number of the keys for symbols, then the number of the last symbols registered by the output registration unit 6 is equal to the difference between the number of the depressed keys for selection of symbols and the depressed keys for symbols, and these are the symbols with the lowest priority carried by the key with the lowest priority from all the depressed keys for symbols. If the number of the depressed keys for symbols is greater than the number of the depressed keys for selection of symbols, then the number of the last symbols registered by the output registration unit 6 is equal to the difference between the depressed keys for symbols and the depressed keys for selection of symbols, and these are the symbols with the chosen lowest priority from the keys for symbols with the lowest priority.

Printing of capital letters

The key 32 for selection of a second symbol is depressed alone in a single stroke. The fact that it has been activated is stored in the memory 2. After the release of the key 32 for selection of a second symbol a "start" signal is produced and is fed to the command unit 37 of the control unit 3, where a signal for the transfer of the information from the memory 2 into the command unit 37 is produced. The command unit 37 activates the pulse generator 43 and the counting unit 38, and a command is issued which is fed to the capital letter unit 39 from which a signal is produced and fed through the OR-gate 42 and decoder 5 into the output registration unit 6, thus bringing the latter in a capital letter mode of operation.

Following the introduction of new information from the keyboard unit 1 into the memory 2 and the working out of a "start" signal by the keyboard unit 1, the information is transferred from the memory 2 into the control unit 3. The latter produces a signal for the activation of the pulse generator 43 and the counting unit 38. Commands are fed through the normal information unit 41 and the OR-gate 42 into the decoder 5 for the sequence of the decoded symbols fed from the decoder 5 into the output registration unit 6 for printing. After the printing of the first symbol as a capital letter by the output registration unit 6, the counting unit 38 produces a signal which is fed into the command unit 37. On the basis of that signal, a command is worked out and fed through the capital letter unit 39, the OR-gate 42 and the decoder 5 into the output registration unit 6 for switching the device into a small letters mode of operation. Therefore, all the next symbols for letters from the introduced group of symbols are printed as small letters. If only the keys 31 and 32 for the selection of a first and a second symbol are depressed simultaneously, then the output registration device 6 is fixed for operation in a capital letter mode until the same keys are depressed again simultaneously.

Passing to a new line by the output registration unit 6

For that purpose, the key 33 for the selection of a third symbol is independently depressed. The fact that it has been activated is stored in the memory 2. After the release of the key 33 for the selection of a third symbol the keyboard unit 1 products a "start" signal which is fed to the control unit 3. Following that signal, the control unit 3 produces a signal for the transfer of the registered information from the memory 2 into the command unit 37. The command unit 37 activates the pulse generator 43 and the counting unit 38, and a command is produced which is fed through the new line unit 40, the OR-gate 42 and the decoder 5 into the output registration unit 6, which passes to a new line. When only the keys 31 and 33 for the selection of a first and a third symbol are depressed simultaneously, the command unit 37 after receiving the "start" signal produces a command which is fed into the new line unit 40 which produces a signal which is fed through the OR-gate 42 and the decoder 5 into the output registration unit 6, which passes to a new line with an indentation. The next command worked out by the command unit 37 is fed into the capital letter unit 39 which produces a signal which is fed through the OR-gate 42 and the decoder 5 into the output registration unit 6. The next introduced group of symbols is printed with a capital letter if the first symbol represents a letter.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. A device for the introduction of linguistic information comprising a keyboard unit, an electronic processing unit and an output registration unit, the keyboard unit having keys for symbols distributed into a right hand side group to be operated by the right hand and a left hand side group to be operated by the left hand, the electronic processing unit containing a memory, a decoder and a control unit, the keyboard unit processing space keys, the keys for symbols in the right hand side group having priority over the keys for symbols in the left hand side group, the keys for symbols in the right hand side group having priority from left to right and from top to bottom, the keys for symbols in the left hand side group having priority from right to left and from top to bottom, with the keys for symbols in the outer end columns of both groups being located one row lower, with the keys for symbols in each group carrying a group of symbols arranged by priority, the symbols being presented once on the keys in the respective groups, the keyboard unit processing keys for the selection of symbols whose number is equal to the number of symbols form the greatest set of symbols carried by a single key for symbols and whose priority follows the priority of the symbols corresponding to them, a key for reversing the priority of the symbols on the keys for symbols, key for reversing the priority of the keys for symbols from the left hand side group with respect to the keys for symbols from the right hand side group, a key for reserving the priority of the keys for symbols in both groups, keys for, introduction of symbols from the left hand side group between symbols from the right hand side group and separate keys and groups of keys having the functions of writing of a capital letter, for passing to a new line, for passing to a new line with an indentation and a capital letter, and for writing of capital letters only.

2. A device according to claim 1, wherein the keyboard unit is coupled to the input-"start" of the control unit and to the input of the memory, the latter connected by a duplex coupling to the control unit, the control unit contains a command unit with the input-start as an input, the command unit having a duplex coupling to a counting unit as well as outputs to a timing pulse generator having an output to said counting unit, to a capital letter unit, to a new line unit and to a normal information unit, the capital letter unit, the new line unit and the normal information unit having an output through an OR-gate to the decoder.

3. A device according to claim 1, wherein the keys for reversing the priority of the keys for symbols in the left hand side group with respect to the keys for symbols from the right hand side group are positioned correspondingly above the uppermost keys for symbols in the left hand side group, there being one key for reversing the said priority of the keys for symbols in the left hand group with respect to those in the right hand group for every column of keys for symbols.

4. A device according to claim 1, wherein the keys for the selection of symbols are positioned under the keys for symbols with the keys for selection of the first, the second and the third symbol forming a group to be operated by the thumb of the right hand, the key for selection of the fourth symbol being positioned under the keys from the rightmost column of keys of the right hand side group and the key for selection of the fifth symbol being positioned to the left of it, the key for the selection of the sixth symbol being positioned under the keys for symbols from the third column from right to left of the left hand side group of keys.

5. A device according to claim 1, wherein the key for reversing the priority of the symbols on the keys for symbols, the key for reversing the priority of the keys for symbols in the group and the keys for the introduction of symbols from the left hand side group between symbols from the right hand side group form a group to be operated by the thumb of the left hand and are positioned under the keys for symbols.

6. A device according to claim 5, wherein the key for reversing the priority of the symbols on the keys for symbols are positioned uppermost in the group and under it from right to left there are positioned the key for reversing the priority of the keys for symbols in the group and the keys for the introduction of symbols from the left hand side group between symbols from the right hand side group.

7. A device according to claim 6, wherein one of the keys for the introduction of symbols is a key for the introduction of symbols from the left hand side group between symbols from the right hand side group after the first printed symbol, and the other key is a key for the introduction of symbols from the left hand side group between symbols from the right hand side group after the second printed symbol.

8. A device according to claim 1, wherein the key for the selection of the third symbol when independently depressed has a function of passing to a new line.

9. A device according to claim 1, wherein the key for the selection of the second symbol when independently depressed has a function of printing the first letter from the introduced group of symbols as a capital letter and the remaining letters as small letters.

10. A device according to claim 1, wherein the keys for the selection of the first and the third symbols when simultaneously depressed have the function of passing to a new line with an indentation and a capital letter.

11. A device according to claim 1, wherein the keys for the selection of the first and the second symbol when simultaneously depressed having the function of printing capital letters only until a repeated depressing of the same group of keys.

12. A device according to claim 1, wherein the keys for symbols in the right hand side group are positioned in two rows with four keys in the first row and three keys in the second row, the keys for symbols in the left hand side group are positioned in two rows with four keys in the first row and four keys in the second row, the keys for symbols in the right hand side group having the following priority from left to right: the first key, the second key, the third key, and the fourth key in the first row, the first key, the second key, and the third key in the second row, and wherein the keys for symbols from the left hand side group have the following priority from right to left: the first key, the second key, the third key, and the fourth key in the first row, the first key, the second key, the third key, and the fourth key in the second row, the space keys being positioned one key above each column of the keys for symbols in the right hand side group.

13. A device according to claim 12, wherein each key for symbols carries information in a set of up to six symbols.

14. A device according to claim 1, wherein the keys for symbols are positioned in such a way as to permit each finger of both hands to operate several keys simultaneously.

15. A device according to claim 1, wherein Cyrillic letters for the Bulgarian language are positioned according to the following priority order from top to bottom:

For the left hand side group from right to left on the first row

| Keys | First (9) | Second (10) | Third (11) | Fourth (12) |
|---|---|---|---|---|
| Symbols | А<br>2 | Е<br>3 | И<br>4 | О<br>5 |

and on the second row

| | Keys | | | |
|---|---|---|---|---|
| | First (13) | Second (14) | Third (15) | Fourth (16) |
| Symbols | у<br>6 | ъ<br>7 | я<br>8 | ю<br>9 |

For the right hand side group from left to right on the first row

| | Keys | | | |
|---|---|---|---|---|
| | First (24) | Second (25) | Third (26) | Fourth (27) |
| Symbols | с<br>л<br>б<br>.<br>+<br>ь | т<br>м<br>у<br>!<br>=<br>э | н<br>д<br>щ<br>?<br>%<br>ы | г<br>к<br>ш<br>,<br>: |

and on the second row

| | Keys | | |
|---|---|---|---|
| | First (28) | Second (29) | Third (30) |
| Symbols | в<br>з<br>[ц<br>№<br>ц<br>"<br>№ | р<br>й<br>ф<br>/<br>ф<br>/ | а<br>х<br>ж<br>7]<br>ж<br>7 |

* * * * *

UNITED STATES PATENT AND TRADEMARK OFFICE

CERTIFICATE OF CORRECTION

PATENT NO. : 4,310,254

DATED : January 12, 1982

INVENTOR(S) : Angel D. Anadoliiski et al.

It is certified that error appears in the above—identified patent and that said Letters Patent is hereby corrected as shown below:

On the Title Page in item (19) "D'Angiolillo" should read -- Anadoliiski --. Same title page item (75) "D'Angiolillo" should read -- Angel D. Anadoliiski --.

Signed and Sealed this

*Eleventh* Day of *May 1982*

[SEAL]

*Attest:*

GERALD J. MOSSINGHOFF

*Attesting Officer*

*Commissioner of Patents and Trademarks*